US010933514B1

(12) United States Patent
Tiefel et al.

(10) Patent No.: US 10,933,514 B1
(45) Date of Patent: Mar. 2, 2021

(54) DEVICE FOR PROTECTING THE HAND WHEN GRIPPING OBJECTS

(71) Applicant: Doozi, LLC, Burlington, NJ (US)

(72) Inventors: Simeon E. Tiefel, Siloam Springs, AR (US); Michael J. Goldman, Delran, NJ (US); Mark A. Adkins, East Brunswick, NJ (US)

(73) Assignee: Doozi, LLC, Burlington, NJ (US)

( * ) Notice: Subject to any disclaimer, the term of this patent is extended or adjusted under 35 U.S.C. 154(b) by 0 days.

(21) Appl. No.: 17/076,666

(22) Filed: Oct. 21, 2020

Related U.S. Application Data

(60) Provisional application No. 63/034,593, filed on Jun. 4, 2020.

(51) Int. Cl.
*B25B 9/00* (2006.01)

(52) U.S. Cl.
CPC ..... *B25B 9/00* (2013.01)

(58) Field of Classification Search
CPC ..... B25B 9/00
See application file for complete search history.

(56) References Cited

U.S. PATENT DOCUMENTS 223,066 A 12/1879 Russell, Jr.
567,087 A * 9/1896 Fitzgerald et al. ..... F24B 15/10 294/11
580,148 A 4/1897 Staples
941,798 A 11/1909 Moore
1,990,553 A 2/1935 Koffler et al.
2,069,449 A 2/1937 Jensen
2,244,072 A 6/1941 Ledbetter
2,757,951 A 8/1956 Benton
2,881,022 A 4/1959 Brust
3,181,198 A 5/1965 Stelzen
4,148,510 A * 4/1979 Brack ..... E01H 1/1206 294/1.3
4,682,803 A 7/1987 Andrews
4,768,288 A * 9/1988 Culbertson ..... A47G 21/02 294/131
4,846,518 A * 7/1989 Hamel ..... A63H 3/003 294/99.1
4,884,581 A * 12/1989 Rescigno ..... A46B 5/04 128/869
4,938,515 A 7/1990 Fazio
4,962,957 A * 10/1990 Traber ..... B25J 1/04 294/100

(Continued)

*Primary Examiner* — Stephen A Vu
(74) *Attorney, Agent, or Firm* — LaMorte & Associates, P.C.

(57) ABSTRACT

A handheld grip assist device for use in gripping an object in a sanitary manner. The grip assist device has a clamshell construction, wherein two assemblies are joined at a hinge. The two assemblies have a rigid frame that support elastomeric panels. Movement between an open configuration and a closed configuration are controlled by engaging the grip assist device between a thumb and finger and using the muscles of the hand to open and close the grip assist device. In this manner, the grip assist device can be precisely controlled while preventing any direct contact between a gripped object and the skin of the hand. The grip assist device can be locked in its closed configuration, therein isolating surfaces on the grip assist device that could cause cross-contamination.

17 Claims, 6 Drawing Sheets

(56) References Cited

U.S. PATENT DOCUMENTS

| | | | | |
|---|---|---|---|---|
| 7,117,536 | B2 | 10/2006 | Burnett et al. | |
| 8,061,749 | B2 * | 11/2011 | Risch | A47J 43/283 294/99.2 |
| D831,896 | S | 10/2018 | Krahe | |
| 2005/0160512 | A1 | 7/2005 | DeYoung et al. | |
| 2007/0210596 | A1 | 9/2007 | Stewart et al. | |
| 2018/0168248 | A1 | 6/2018 | Cicco et al. | |

* cited by examiner

DEVICE FOR PROTECTING THE HAND WHEN GRIPPING OBJECTS

RELATED APPLICATIONS

This application claims the benefit of U.S. Provisional Patent Application No. 63/034,593, filed Jun. 4, 2020.

BACKGROUND OF THE INVENTION

1. Field of the Invention

In general, the present invention relates to grip assist devices that are held by one hand and enable a person to grip an object as well as prevent contamination from occurring between the object and the skin of the hand.

2. Prior Art Description

There are many devices in the prior art that are intended to improve the gripping action of the hand. Many of these prior art devices have a clamshell construction, where two opposing surfaces are joined by a hinge. The opposing surfaces can be squeezed together or moved apart between the thumb and fingers. In the prior art, many of these devices are intended to grasp slippery objects, such as fish. In this manner, the object can be firmly held, while the hand is protected from physically touching the object. Such prior art is exemplified by U.S. Pat. No. 4,682,803 to Andrews, U.S. Pat. No. 3,181,198 to Stelzen, and U.S. Pat. No. 4,938,515 to Fazio.

Similar grip assist devices can be produced simply by folding a layer of protective material between the thumb and fingers prior to grasping an object. Such prior art is exemplified by U.S. Pat. No. 2,069,449 to Jensen, U.S. Pat. No. 7,117,536 to Burnett, and U.S. Patent Application Publication No. 2018/0168248 to Cicco. The problem with such prior art grip assist devices is that the grip assist device is intended to increase the friction of the grip and/or prevent contact with the object. Such prior art grip assist devices are not designed to prevent cross-contamination between the grip assist device and the hand using the device. For example, when a prior art grip assist device is used to contact a contaminated object, surfaces of the grip assist device becomes contaminated. The user's hand can contact these contaminated surfaces simply by removing the grip assist device from the hand or holding the grip assist device.

Grip assist devices that use a hinge are typically spring loaded into an open configuration. In this manner, the surfaces that touch a contaminated object are exposed. Such grip assist devices must be washed after each use to prevent cross-contamination. Furthermore, grip assist devices that are folded in half lack any mechanisms to keep the device folded in half after use. As such, the grip assist device has contaminated surfaces that are easily exposed as the device is manipulated or held in a pocket. Folding grip assist devices must be either washed or thrown away after use to prevent cross-contamination.

A need therefore exists for a grip assist device that can be used multiple times by a user without the need to be washed or replaced, wherein the grip assist device enables a person to grip a contaminated object without exposure to cross-contamination. This need is met by the present invention as described and claimed below.

SUMMARY OF THE INVENTION

The present invention is a handheld grip assist device for use in gripping an object in a sanitary manner. The grip assist device has a clamshell construction, wherein two assemblies are joined at a hinge. The first assembly has a first rigid frame and a first elastomeric panel. The first frame suspends said first elastomeric panel in a first plane. Likewise, the second assembly has a second rigid frame and a second elastomeric panel. The second rigid frame suspends the second elastomeric panel in a second plane.

The first assembly is joined to the second assembly at a hinge joint that enables the first assembly to rotate relative to the second assembly between a closed configuration, where said first plane and said second plane are parallel, and an open configuration, where said first plane and said second plane diverge. Movement between the open configuration and the closed configuration are controlled by engaging the grip assist device between a thumb and finger and using the muscles of the hand to open and close the grip assist device. In this manner, the grip assist device can be precisely controlled while preventing any direct contact between a gripped object and the skin of the hand. The grip assist device can be locked in its closed configuration, therein isolating surfaces on the grip assist device that could cause cross-contamination.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention grip assist device can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the appended claims.

Figure 1:
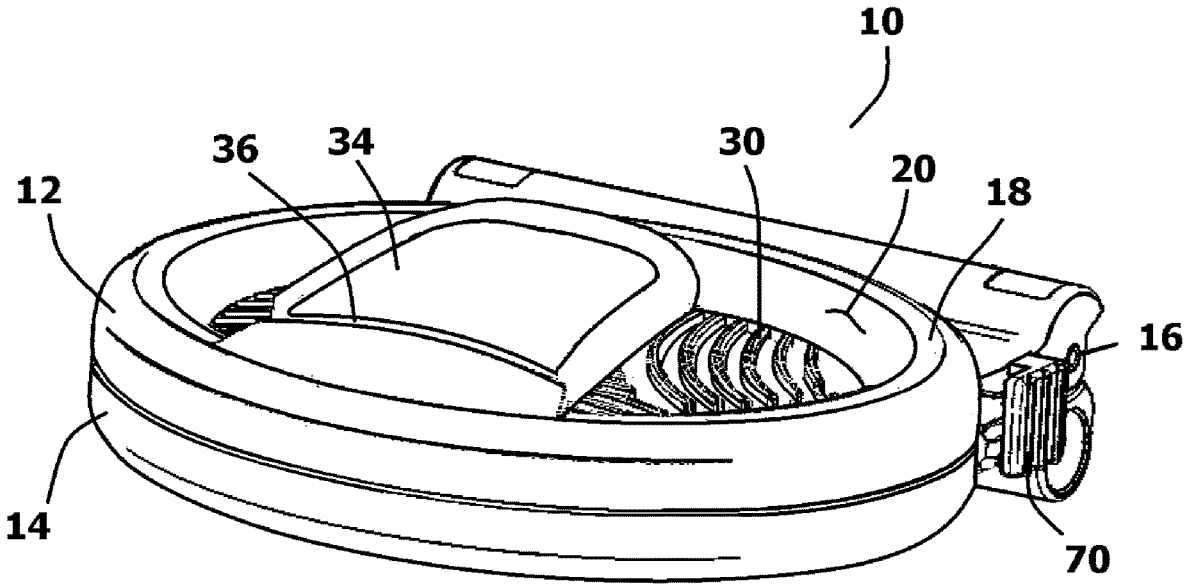
FIG. 1 is a perspective view of an exemplary embodiment of a grip assist device in a closed configuration.
Figure 2:
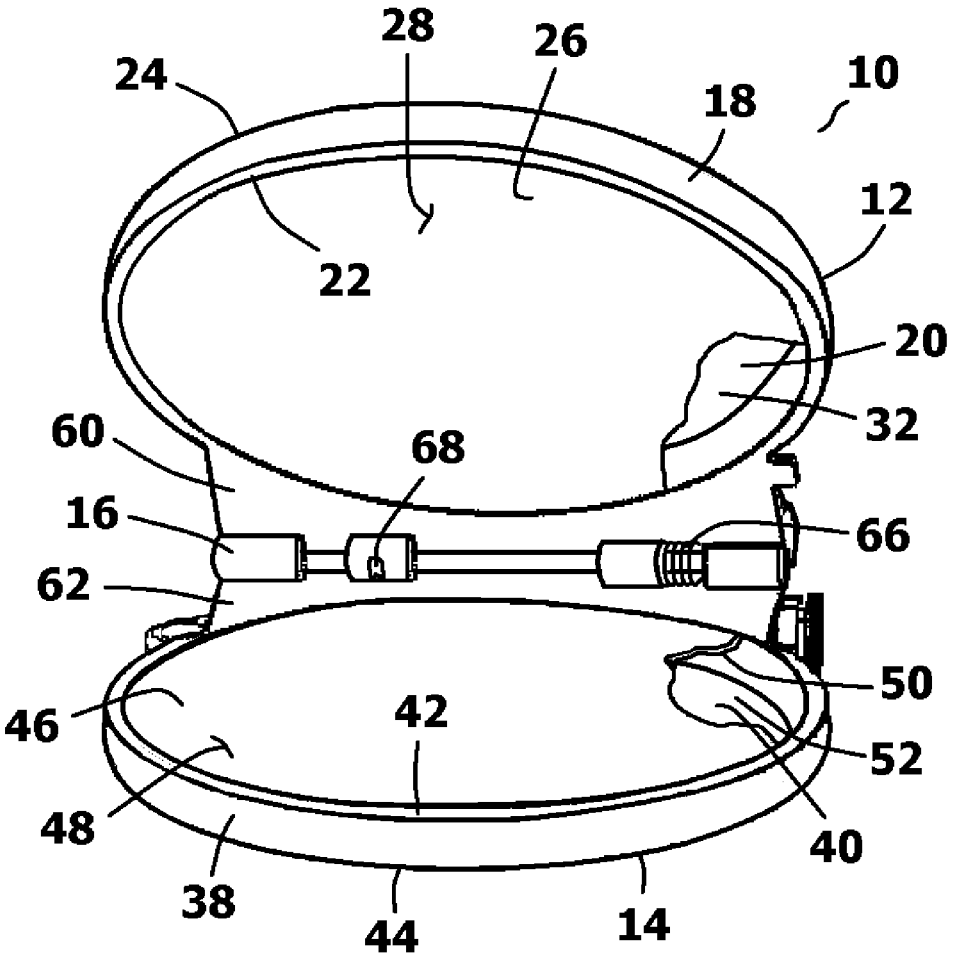
FIG. 2 is a perspective view of an exemplary embodiment of a grip assist device in an open configuration.
Figure 3:
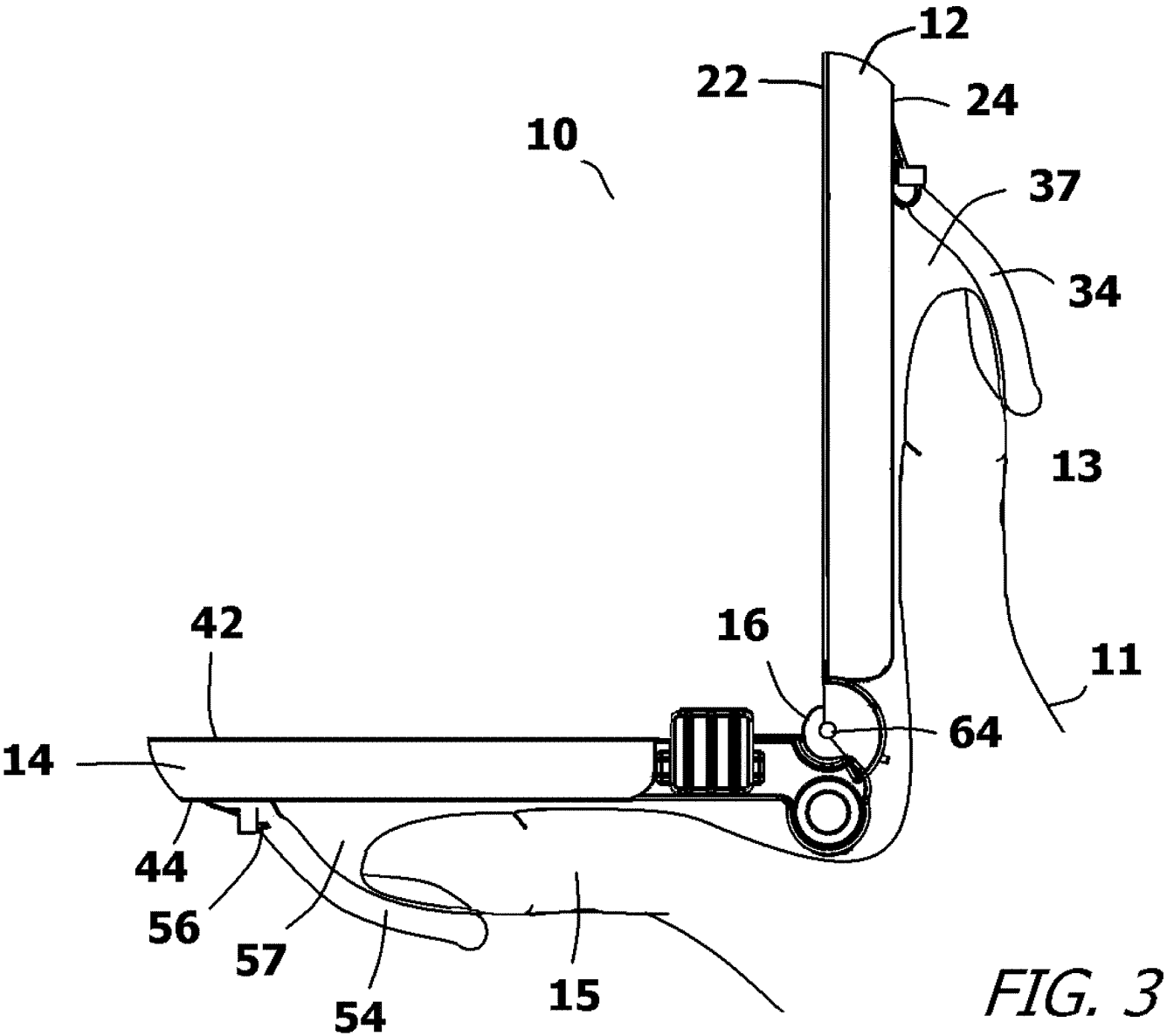
FIG. 3 is a side view of the grip assist device of FIG. 1 shown in conjunction with a user's hand.

Referring to FIG. 1, FIG. 2, and FIG. 3, a grip assist device 10 is shown. The grip assist device 10 is held in one hand 11 between a finger 13 and a thumb 15. The purpose of the grip assist device 10 is to enable a person to grip and manipulate an object, such as doorknobs, while preventing any direct physical contact between the user's fingers/hand and the object being gripped.

The grip assist device 10 has a clamshell design. That is, there is a first assembly 12 and a second assembly 14 that are joined together by a common hinge joint 16. The hinge joint 16 enables the grip assist device 10 to be selectively moved between an open configuration (FIG. 2 & FIG. 3) and a closed configuration (FIG. 1). As is later explained, all contact contaminated surfaces of the grip assist device 10 are isolated when the grip assist device 10 is in its closed configuration.

The first assembly 12 has a first frame 18. In the shown embodiment, the first frame 18 is elliptical in shape. However, it will be understood that round shapes and polygonal shapes can also be used. What is of importance is that the first frame 18 defines the periphery of a central opening 20. The first frame 18 has an inner rim 22 and an outer rim 24. When the grip assist device 10 is in use, it is the inner rim 22 that faces the object being gripped.

The central opening 20 of the first frame 18 is covered by a thin first panel 26 of an elastomeric material, such as silicone. The first panel 26 is thin enough to be easily deformable when brought into contact with a rigid object. The first panel 26 has a smooth surface 28 and an opposite textured surface 30. The first panel 26 is suspended within the first frame 18 so that the smooth surface 28 is essentially coplanar with the inner rim 22 of the first frame 18. Since the smooth surface 28 of the first panel 26 is aligned with the inner rim 22 of the first frame 18, the opposite textured surface 30 is positioned inside the first frame 18. The textured surface 30 of the first panel 26 and the first frame 18 combine to form a first recessed area 32 within the interior of the first frame 18.

A first finger tab 34 extends from the outer rim 24 of the first frame 18 over the first recessed area 32. A thinned section of the first finger tab forms a living hinge 36, therein enabling the first finger tab 34 to bend without damage when stressed. The first finger tab 34 extends over part of the first recessed area 32. This creates a first finger pocket 37 between the first finger tab 34 and the first recessed area 32. The first finger pocket 37 can receive one or more fingers 13 on the hand 11 of a user.

The second assembly 14 is very similar in structure to the first assembly 12. The second assembly 14 has a second frame 38. The shape of the second frame 38 mirrors the shape of the first frame 18. The second frame 38 defines the periphery of a central opening 40. The second frame 38 has an inner rim 42 and an outer rim 44. When the grip assist device 10 is used, it is the inner rim 42 that faces the object being gripped.

The central opening 40 of the second frame 38 is covered by a second panel 46 of elastomeric material. The second panel 46 of elastomeric material has a smooth surface 48 and a textured surface 50. The second panel 46 of elastomeric material is suspended within the second frame 38 so that the smooth surface 48 is coplanar with the inner rim 42 of the second frame 38. Since the smooth surface 48 of the second panel 46 is aligned with the inner rim 42 of the second frame 38, the textured surface 50 is positioned inside the second frame 38. The textured surface 50 of the second panel 46 and the second frame 38 combine to form a second recessed area 52 within the second frame 38.

A second finger tab 54 extends from the outer rim 44 of the second frame 38 over the second recessed area 52. A thinned section of the second finger tab 54 forms a living hinge 56, therein enabling the second finger tab 54 to bend without damage when stressed. The second finger tab 54 extends over part of the second recessed area 52. This creates a second finger pocket 57 between the second finger tab 54 and the second recessed area 52. The second finger pockets 57 can receive the thumb 15 of the user.

A first hinge extension 60 extends from the first frame 18. Likewise, a second hinge extension 62 extends from the second frame 38. The first hinge extension 60 and the second hinge extension 62 are joined by a hinge pin 64. This creates the hinge joint 16 between the first assembly 12 and the second assembly 14. The hinge joint 16 enables the first assembly 12 and the second assembly 14 to rotate relative each other between a closed configuration (FIG. 1) and an open configuration (FIG. 2 and FIG. 3). In the closed configuration, the first panel 26 and the second panel 46 abut against each other in parallel orientations. The first panel 26 and the second panel 46 are isolated when in the closed configuration. In the open configuration, the first panel 26 and the second panel 46 diverge at an angle of between seventy degrees and ninety degrees. A spring 66 is provided that biases the first assembly 12 and the second assembly 14 into the open configuration. A detent 68 can also be provided in the hinge joint 16 that opposes the spring bias. The detent 68 requires a person provide a small separating force between the first assembly 12 and the second assembly 14 before the spring bias takes effect. A slide lock 70 is provided on the side of the grip assist device 10 to lock the grip assist device 10 in its closed configuration when not in use.

Figure 4:
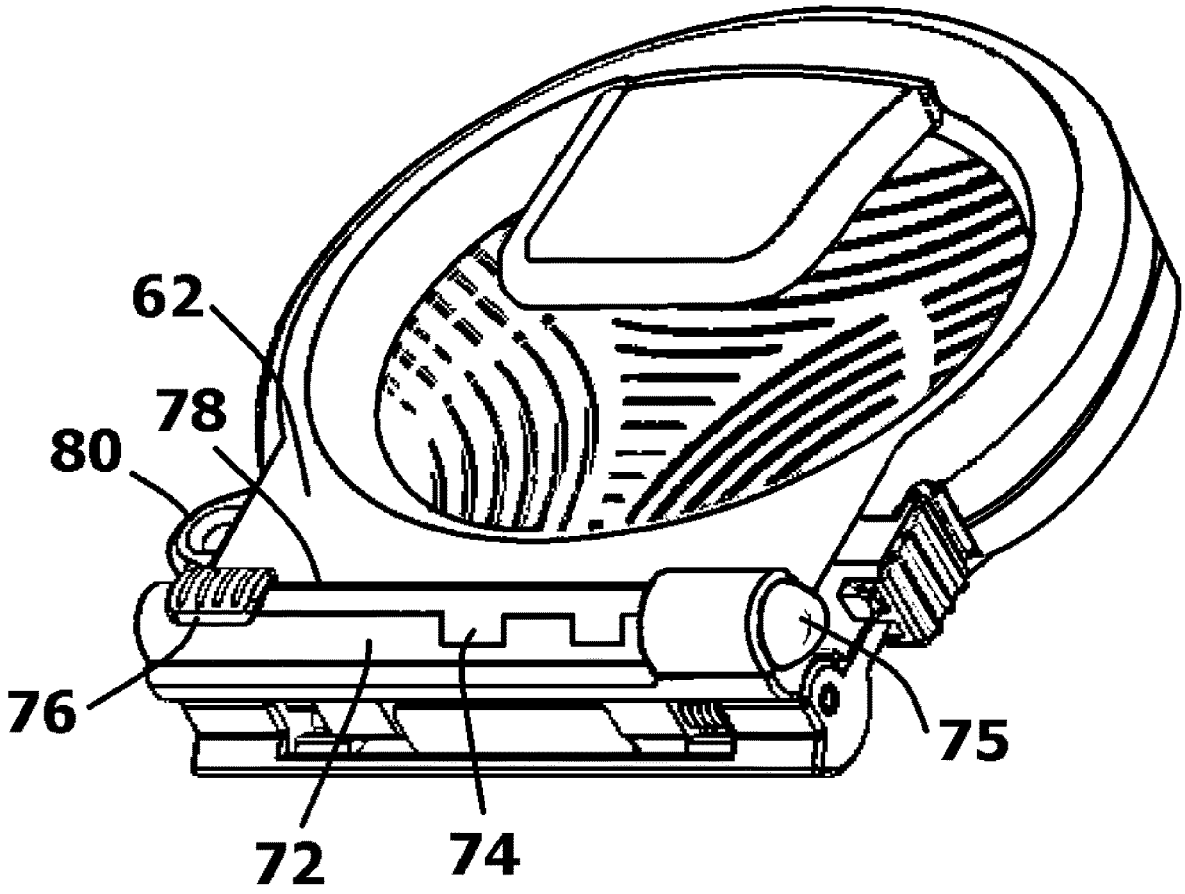
FIG. 4 is a rear perspective view of the grip assist device of FIG. 1 shown with a retracted extension rod.
Figure 5:
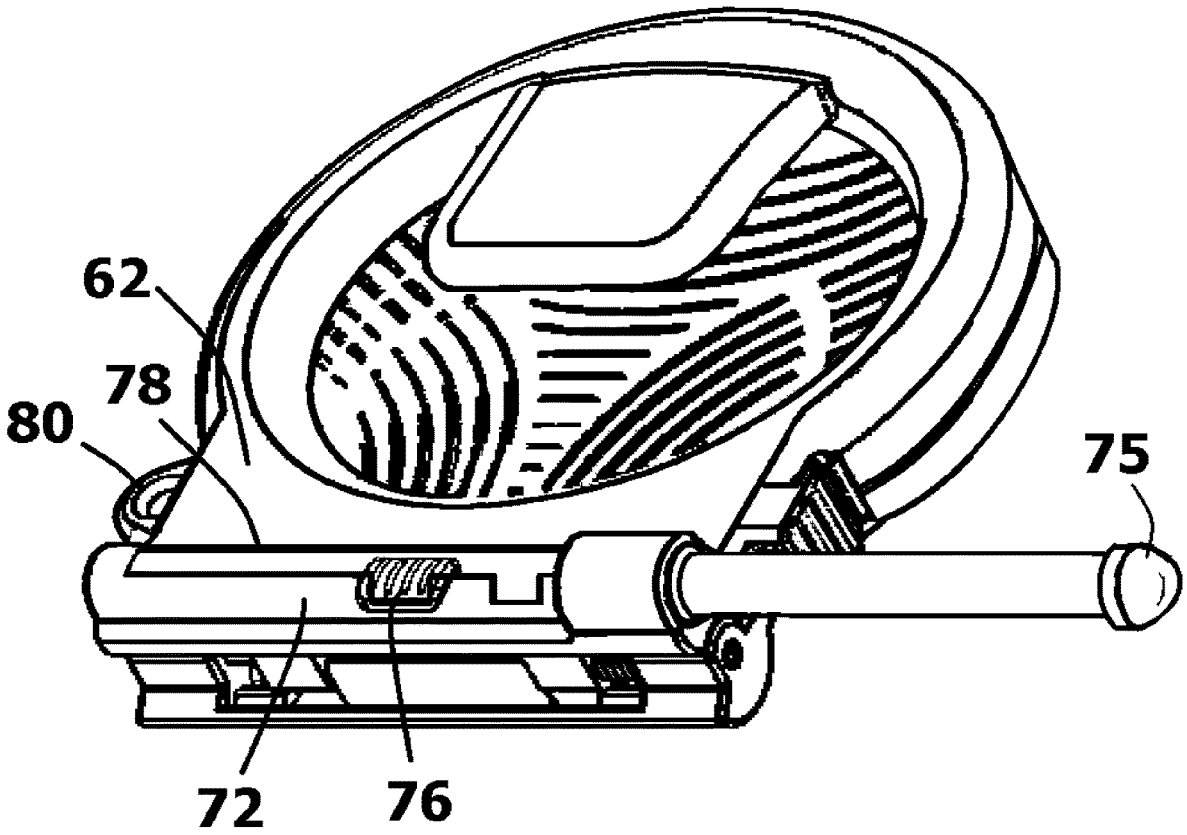
FIG. 5 is a rear perspective view of the grip assist device of FIG. 1 shown with an extended extension rod.

Referring to FIG. 4 and FIG. 5 in conjunction with FIG. 3, it can be seen that in addition to housing half of the hinge joint 16, the second hinge extension 62 of the first assembly 12 supports a tubular conduit 72. The tubular conduit 72 supports an extendable rod 74. The tubular conduit 72 is slotted. The extendable rod 74 is attached to a finger pad 76. The extendable rod 74 terminates with a tip 75. The finger pad 76 rides in a slot 78 that is formed in the tubular conduit 72. As such, the extendable rod 74 can be extended and retracted by manually sliding the finger pad 76 in the slot 78.

An eyehole 80 is attached to either the first assembly 12 or the second assembly 14 near the hinge joint 16. The eyehole 80 can be used to attach a tether or a key ring to the grip assist device 10.

Referring to FIG. 3 in conjunction with FIG. 1 and FIG. 5, it will be understood that to use the grip assist device 10, a person holds the grip assist device 10 in one hand. The thumb 15 is placed in the second finger pocket 37 of the second assembly 14. The index finger and/or middle finger 13 are placed in the first finger pocket 37 of the opposite second assembly 14. The two assemblies 12, 14 are unlocked, wherein the spring 66 biases the first assembly 12 and the second assembly 14 apart. The movement of the hand 11 can counter the bias of the spring 66 and selectively close the grip assist device 10. When the grip assist device 10 is closed around an object, the elastomeric material within the first panel 26 and the second panel 46 deforms to the shape of the object. This presses the first panel 26 and the second panel 46 against the finger 13 and thumb 15, respectively. Thus, the force applied to the object can be directly controlled by sensory touch feedback. The elastomeric material used for the first panel 26 and the second panel 46 also provides a high level of friction so that the object can be firmly grasped. As such, a person can grip and manipulate objects with great sensitivity and without having any skin contact those objects. After use, the first panel 26 and the second panel 46 are potentially contaminated by the object that was grasped. The grip assist device 10 is set into its closed configuration and locked. The first panel 26 abuts against the second panel 46, therein physically isolating the first panel 26 and the second panel 46.

Figure 6:
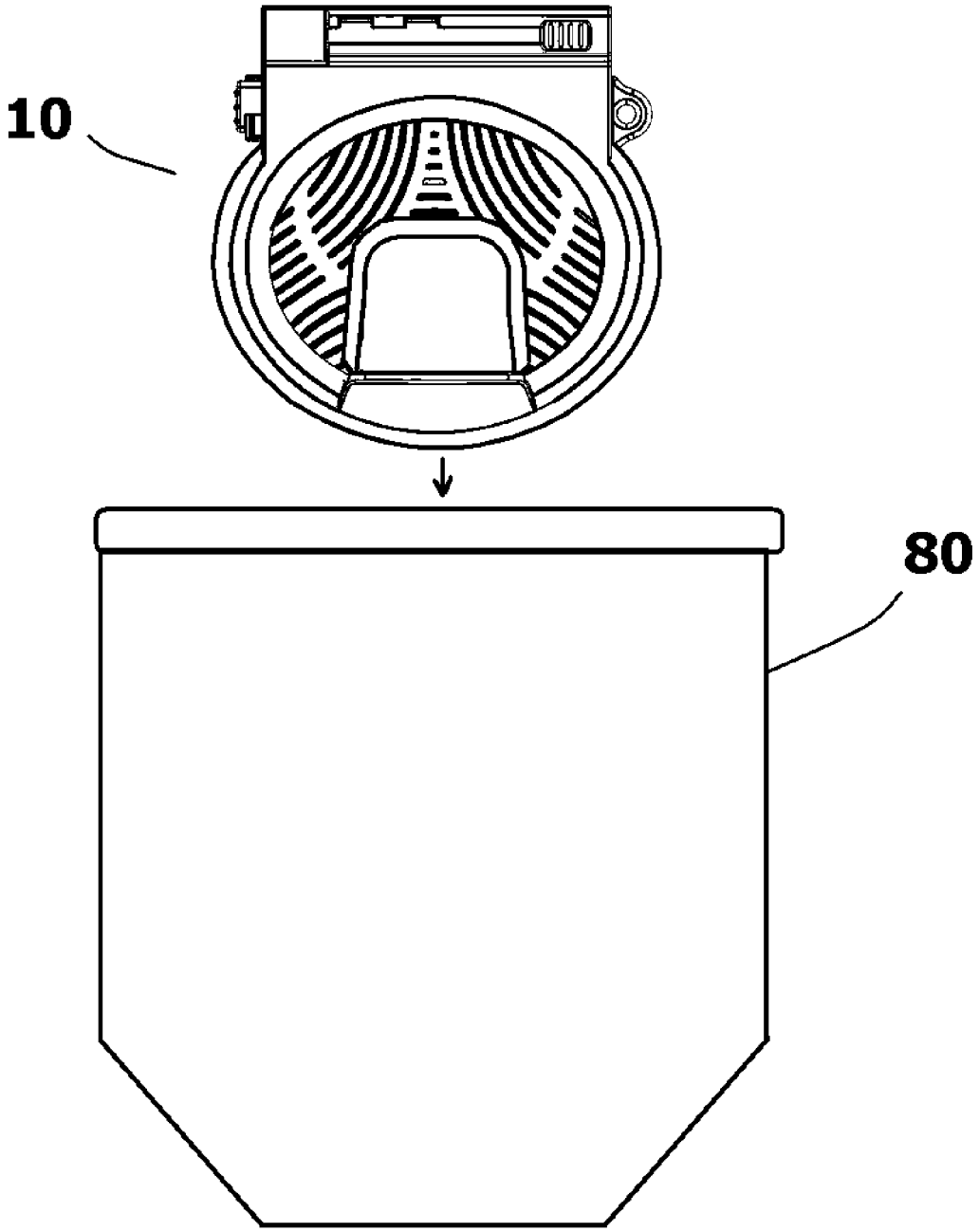
FIG. 6 is a front view of the grip assist device of FIG. 1 shown in a closed configuration in conjunction with a pocket.

Referring to FIG. 6 in conjunction with FIG. 1, it can be seen that once locked into the closed configuration with the slide lock 70, none of the exposed surfaces on the grip assist device 10 present cross-contamination hazards. The grip assist device 10 can then be safely held in a user's pocket 80 or a carry bag without contamination concerns.

Referring to FIG. 4 and FIG. 5, it can be seen that if a person needs to touch a keypad or a touch screen, the extension rod 74 can be selectively deployed. The extendable rod 74 can be used to touch the keypad without any skin contamination. The extendable rod 74 can be constructed with a conductive silicon tip 75. In this manner, the extendable rod 74 can made to be as conductive to the user's skin.

After use, the extendable rod 74 is retracted and the grip assist device 10 is locked in its closed configuration. This shields all surfaces on the grip assist device 10 that may have contacted a contaminated surface. The grip assist device 10 can then be safely held in a user's pocket or carry bag without contamination concerns.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A handheld device for use in gripping an object in a sanitary manner, said device comprising:

a first assembly having a first rigid frame that defines a central opening and a first elastomeric panel, wherein said first rigid frame suspends said first elastomeric panel in a first plane that covers said central opening;

a first finger pocket on said first assembly;

a second assembly having a second rigid frame and a second elastomeric panel, wherein said second rigid frame suspends said second elastomeric panel in a second plane;

a second finger pocket on said second assembly wherein said first assembly is joined to said second assembly at a hinge joint that enables said first assembly to rotate relative to said second assembly between a closed configuration, where said first plane and said second plane abut in parallel, and an open configuration, where said first plane and said second plane diverge; and a lock for selectively locking said first assembly and said second assembly into said closed configuration.

2. The device according to claim 1, wherein said first elastomeric panel has a first surface and an opposite second surface, wherein said first surface faces said second elastomeric panel when said assembly is in said closed configuration.

3. The device according to claim 1, further including a finger tab that extends from said first rigid frame over said central opening, wherein said first finger pocket is defined between said second surface of said first elastomeric panel and said finger tab.

4. The device according to claim 3, wherein said finger tab is integrally molded with said first rigid frame, wherein said a living hinge is molded between said finger tab and said first rigid frame that enables said finger tab to flex relative to said first rigid frame.

5. The device according to claim 1, further including a spring for biasing said first assembly and said second assembly into said open configuration.

6. The device according to claim 5, further including a detent lock that counteracts said spring and resists at least some movement of said first assembly and said second assembly from said closed configuration to said open configuration.

7. The device according to claim 1, further including a retractable rod that can be selectively extended from said device.

8. The device according to claim 7, further including a tubular conduit that houses said retractable rod and protects said retractable rod from contact when retracted.

9. The device according to claim 7, wherein said retractable tubular conduit has a contact head and both said retractable rod and said contact head are conductive.

10. A handheld device for use in gripping an object in a sanitary manner, said device comprising:

a first frame that defines a first central opening, wherein said first frame has an inner rim and an outer rim that encircles said first central opening;

a first elastomeric panel suspended across said first central opening by said first frame;

a first hinge extension that extends from said first frame;

a second frame that defines a second central opening, wherein said second frame has a first rim and a second rim that encircle said second central opening;

a second elastomeric panel suspended across said second central opening by said second frame;

a second hinge extension that extends from said second frame; and wherein said first hinge extension is joined to said second hinge extension at a hinge joint that enables said first frame to rotate relative to said second frame between an closed configuration, where said inner rim and said first rim abut in parallel plane, and an open configuration, where said inner rim and said first rim are spaced apart.

11. The device according to claim 10, wherein said first elastomeric panel is coplanar with said inner rim of said first frame and said second elastomeric panel is coplanar with said first rim of said second frame.

12. The device according to claim 10, wherein said first elastomeric panel has a first surface and an opposite second surface, wherein said first surface faces said second elastomeric panel when said assembly is in said closed configuration, therein protecting said first surface and said second surface from external contact.

13. The device according to claim 10, further including a first finger pocket supported by said first frame and a second finger pocket supported by said second frame.

14. The device according to claim 13, further including a finger tab that extends from said first frame over said first central opening, wherein said first finger pocket is defined between said second surface of said first elastomeric panel and said finger tab.

15. The device according to claim 10, further including a spring for biasing said first frame and said second frame into said open configuration and a lock for selectively locking said first frame and said second frame into said closed configuration.

16. The device according to claim 10, further including a retractable rod that can be selectively extended from said first frame.

17. A handheld device for use in gripping an object in a sanitary manner, said device comprising:

a first frame that defines a first central opening, wherein said first frame has an inner rim and an outer rim that encircles said first central opening;

a first hinge extension that extends from said first frame;

a second frame that defines a second central opening, wherein said second frame has a first rim and a second rim that encircle said second central opening;

a second hinge extension that extends from said second frame;

wherein said first hinge extension is joined to said second hinge extension at a hinge joint that enables said first frame to rotate relative to said second frame between an closed configuration, where said inner rim and said first rim abut in parallel plane, and an open configuration, where said inner rim and said first rim are spaced apart;

a spring for biasing said first frame and said second frame into said open configuration; and a lock for selectively locking said first frame and said second frame into said closed configuration.

* * * * *